United States Patent [19]

Trochman

[11] 4,193,414

[45] Mar. 18, 1980

[54] COLLAPSIBLE AND PORTABLE STRUCTURE

[76] Inventor: John E. Trochman, Delano, Delano, Minn. 55328

[21] Appl. No.: 918,959

[22] Filed: Jun. 26, 1978

[51] Int. Cl.[2] ..... A45F 1/16

[52] U.S. Cl. ..... 135/4 R

[58] Field of Search ..... 135/4 R, 1 R, 3 R; 52/86, 109, 63

[56] References Cited

U.S. PATENT DOCUMENTS

| | | | |
|---|---|---|---|
| 1,009,783 | 11/1911 | Padley | 135/4 R |
| 3,480,023 | 11/1969 | McConnell | 135/1 R |
| 3,559,353 | 2/1971 | Partridge | 135/1 R |
| 3,892,094 | 7/1975 | Spray | 52/63 |
| 4,067,347 | 1/1978 | Lipinski | 135/4 R |

FOREIGN PATENT DOCUMENTS

| | | | |
|---|---|---|---|
| 565831 | 12/1932 | Fed. Rep. of Germany | 135/4 R |

*Primary Examiner*—Reinaldo P. Machado

*Attorney, Agent, or Firm*—James R. Cwayna

[57] ABSTRACT

A collapsible and portable, tent-like structure including a frame portion and a covering portion for the frame and including frontal and rear panels which are easily attachable to the frame portion when the same is erected. The structure allows a plurality of units to be joined in end-to-end relation. The frame structure is provided from a plurality of scissor sections having selected portions of each scissor section being joined to the next adjacent scissor section with the sections of one scissor section being positioned with respect to the next such section to bring other selected portions thereof into abutment with other selected portions of the next adjacent scissors section. This relationship allows both an over-center relation of adjacent scissors sections and also provides an abutment locking arrangement between adjacent scissor sections. The unit also provides cover tensioning means for the main covering of the framework and means for securing the unit to the ground or other supporting surface.

6 Claims, 16 Drawing Figures

COLLAPSIBLE AND PORTABLE STRUCTURE

FIELD OF THE INVENTION

This invention relates generally to collapsible and portable structures and more specifically to such a structure including a unit having a frontal and rear framework provided from a collapsible, scissors frame construction and with the frontal and rear framework being joined with a plurality of longitudinally extending supports, such unit including a cover which may be tightened on the framework with further means for closing the frontal and rear ends of the framework, such closure means being easily attached to the framework and the main covering element being positioned to cover attached portions of the frontal and rear closures.

BACKGROUND AND OBJECTS OF THE INVENTION

The use of tubular or similar frameworks for collapsible or easily disassembled units for use with portable shelters is not new to the art. The prior art illustrates several various forms for such units and these include prior art patents to Nickles, U.S. Pat. No. 1,773,847 and Snouffer, U.S. Pat. No. 1,701,428. These prior art patents illustrate the use of hinged sections for initially collapsing certain portions of the unit but thereafter no provision is made to reduce the height of the collapsed structure. Neither is there a multiplicity of like members to permit any further collapsing of these units other than to bring the sides thereof together. Additional, mult-linkage units such as Thomka, U.S. Pat. No. 3,604,439 and Engle, U.S. Pat. No. 3,501,876 are also shown in the prior art but the formation of the support structures in each of these references include particular joint locking arrangements which rely on additional mechanical devices as compared to the invention as disclosed herein. A patent to Partridge, U.S. Pat. No. 3,559,353 provides a scissors structure but the elements of the scissors are stressed to provide a predetermined shape to the support framework.

Applicant's device provides a simple scissors arrangement to establish a supporting framework when in open position and which permits shifting of the entire framework to provide a package of minimal width with each framework section being in close, side-by-side relation.

The framework as provided herein provides anchoring means for securing the structure to a supporting surface and allows either one such unit to be set up or allows a plurality of such units to be joined in end-to-end relation to provide a continuous shelter unit with the covering thereof allowing a continuous exterior surface between such adjacent units.

The important aspects of the structure disclosed and claimed herein provides for an extremely light weight unit providing a maximum amount of interior covered area and provides such a unit through a simple scissor framework which, due to the design thereof and the interaction of the scissor framework provides a high strength factor.

It is therefore an object of this invention to provide a collapsible shelter structure incorporating a scissor framework which allows the same to be collapsed into a substantially compact package for transportation thereof.

It is a further object of this invention to provide a collapsible shelter structure having a frontal and rear framework and which front and rear framework are joined through a plurality of longitudinally extending members for not only connecting such framework sections but also providing longitudinal support to a flexible covering which extends over the framework.

It is still a further object of this invention to provide a collapsible and portable shelter structure which is designed to permit longitudinal joinder of a plurality of such units and which permits the covering of one of such units to extend over onto the other adjacent unit such that the covering is substantially continuous.

It is still a further object of this invention to provide a collapsible shelter structure having a covering over a supporting framework with means for tightening the covering.

It is still a further object of this invention to provide a collapsible shelter structure formed of a plurality of tubular linkage members such that the resulting framework for the same is substantially light in weight while still affording sufficient strength for its intended useage.

These and other objects and advantages of this invention will become obvious from the following description made in connection with the accompanying drawings in which the same indicia is used for the same or similar parts throughout the several views, and in which.

Figure 1:
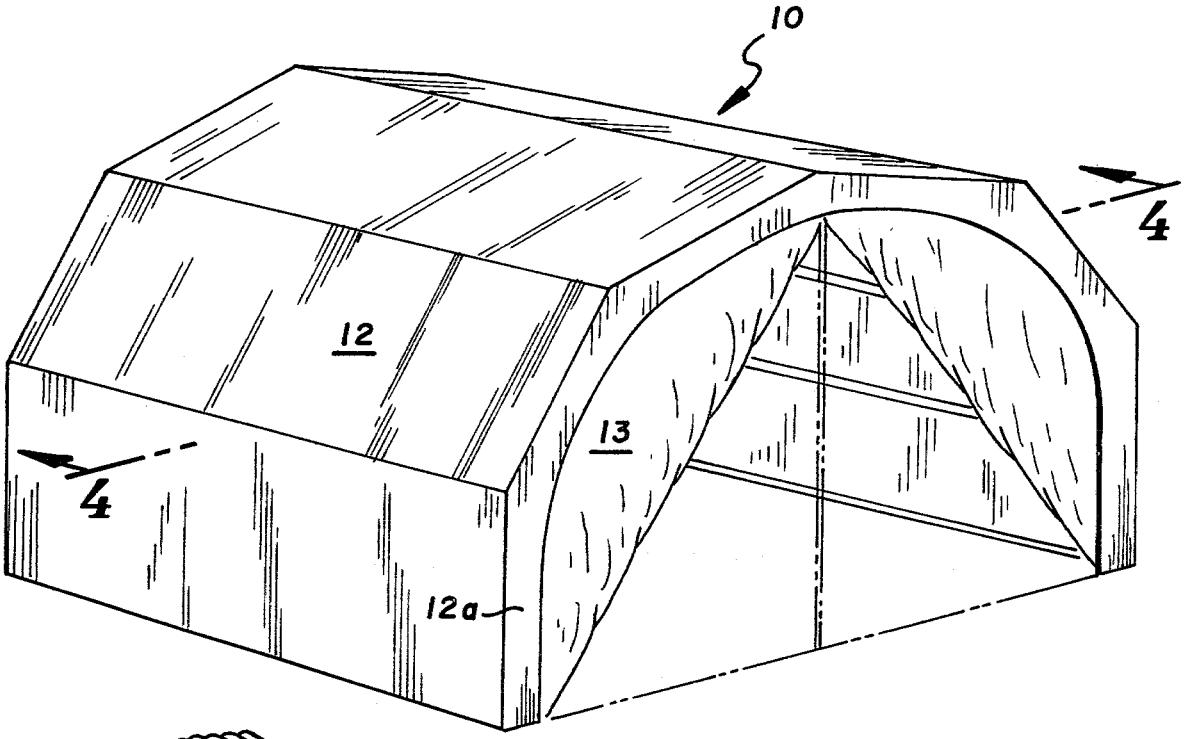
FIG. 1 is a perspective view of a collapsible shelter structure embodying the concepts of the invention and illustrating the same with a frontal cover or panel in which the frontal panel is illustrated in an open and a closed position and portraying a zipper closure therefore, the entire unit shown in erected position.
Figure 4:
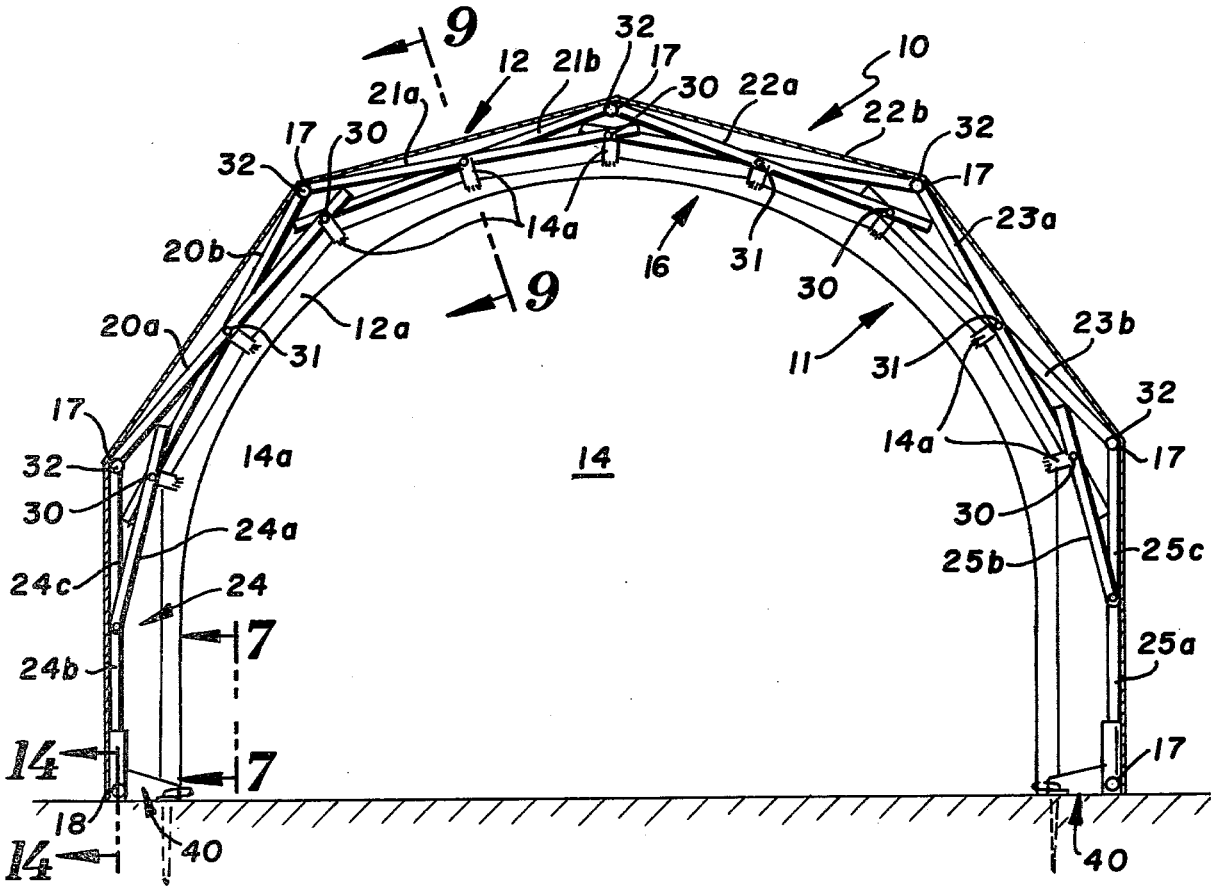
Figure 5:
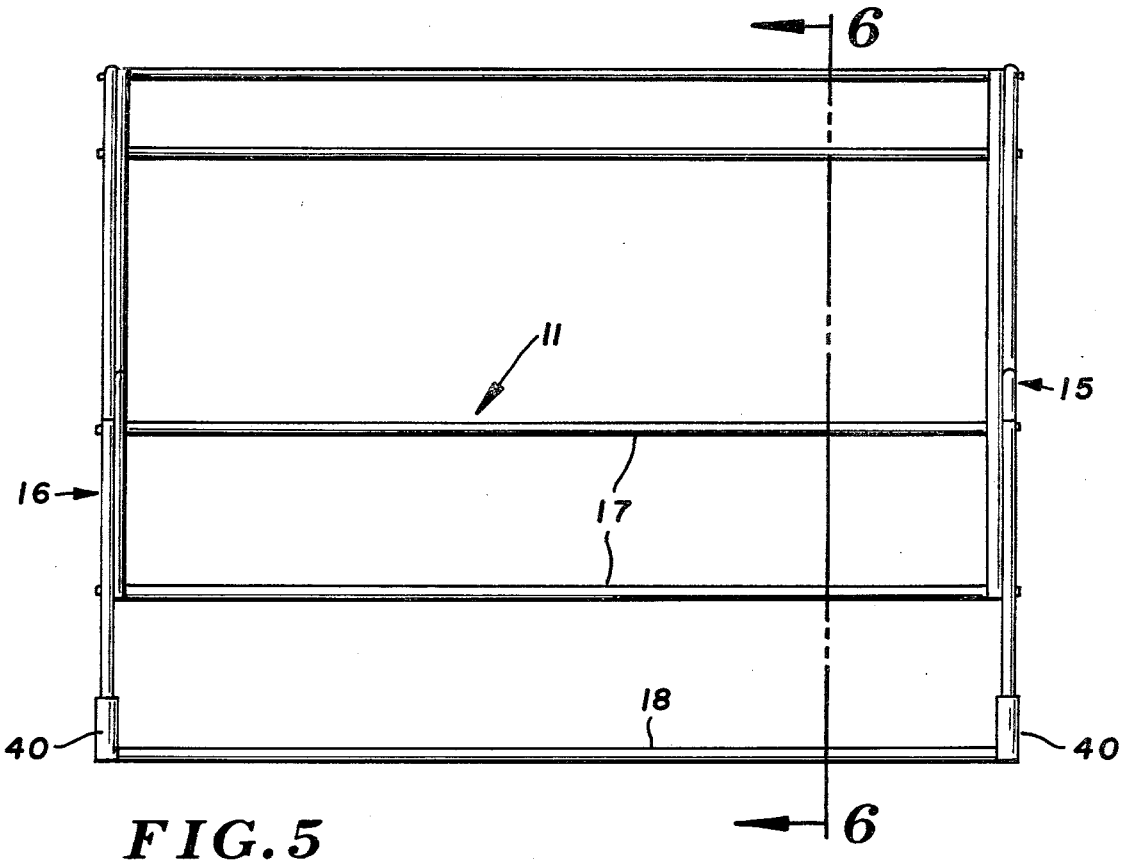
Figure 6:
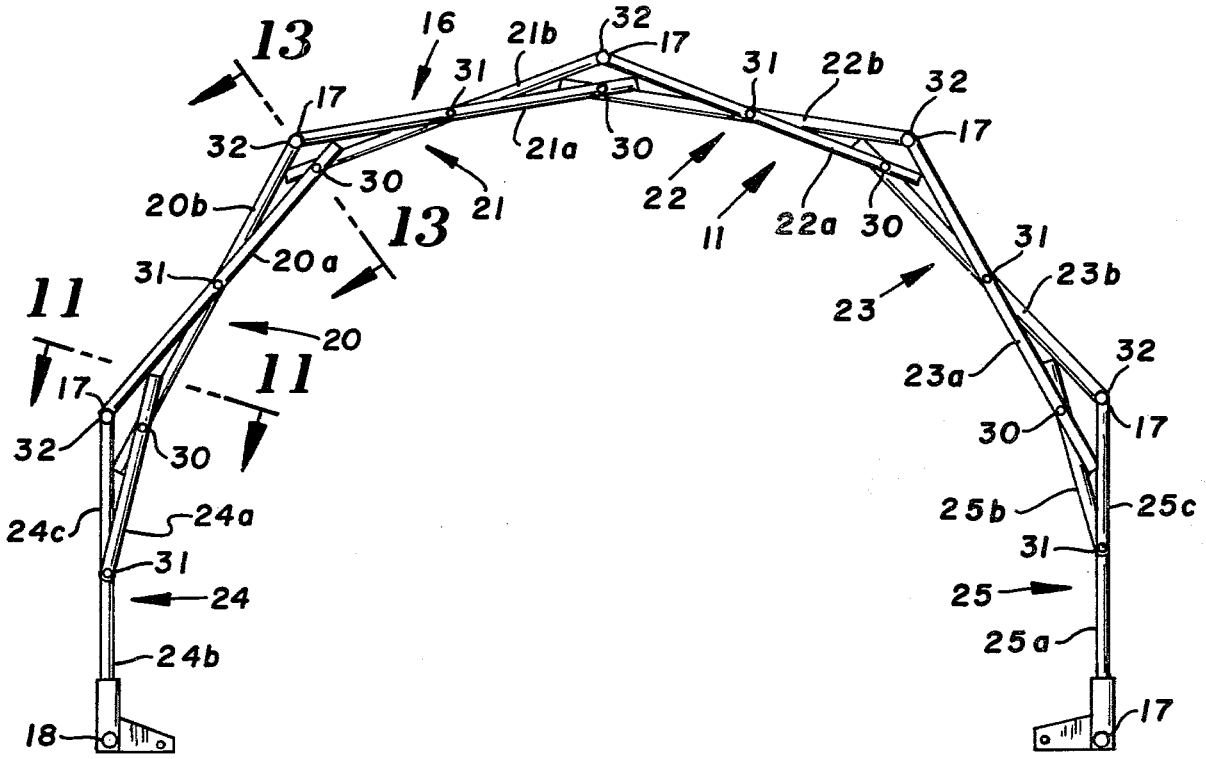
Figure 7:
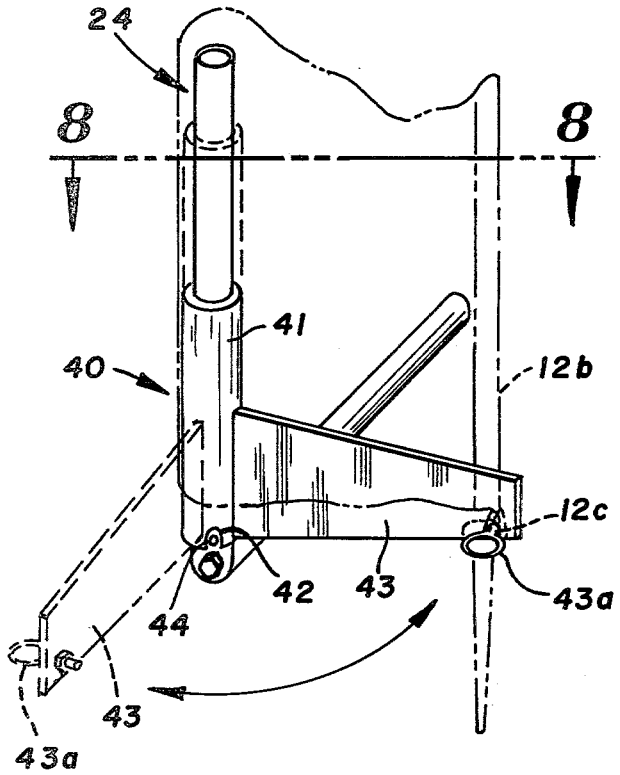
Figure 8:
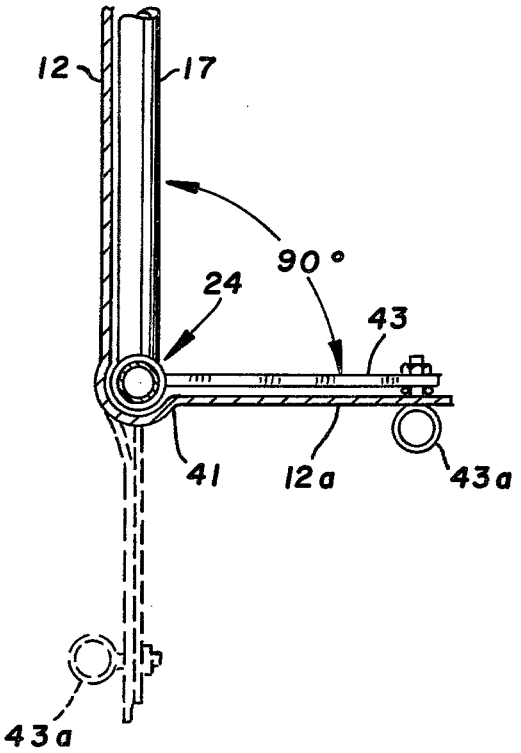
Figure 9:
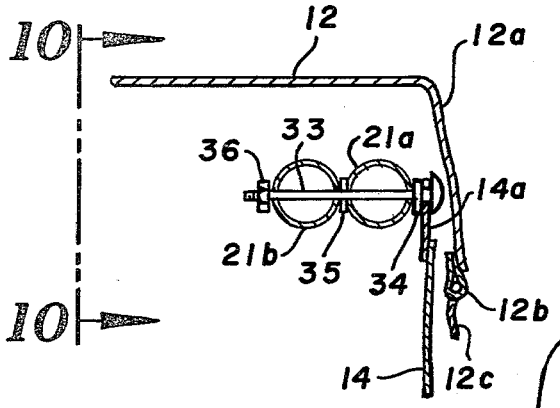
Figure 10:
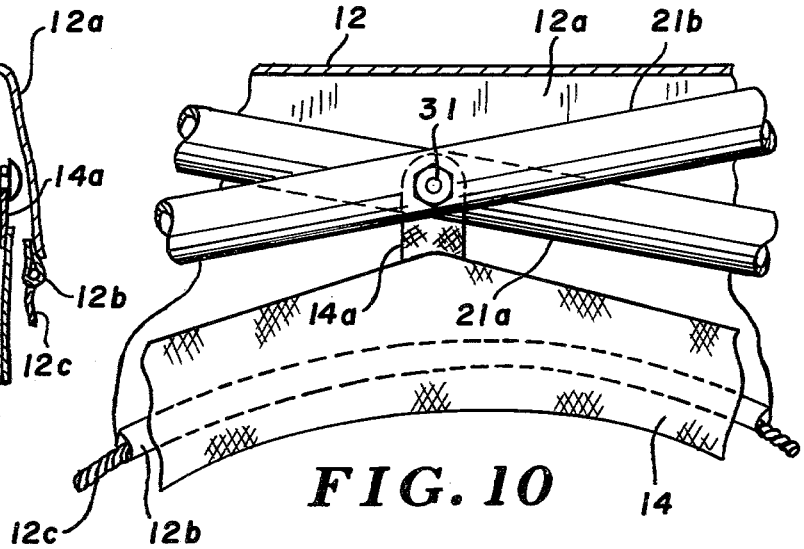
Figure 11:
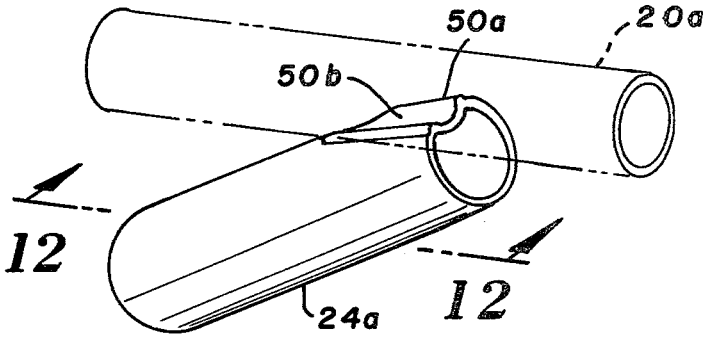
Figure 12:
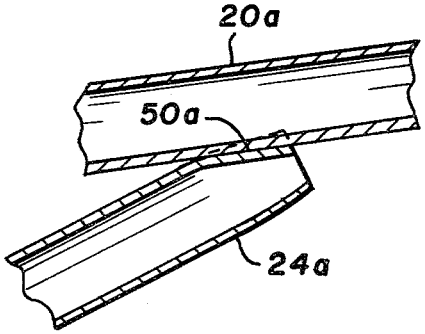
Figure 13:
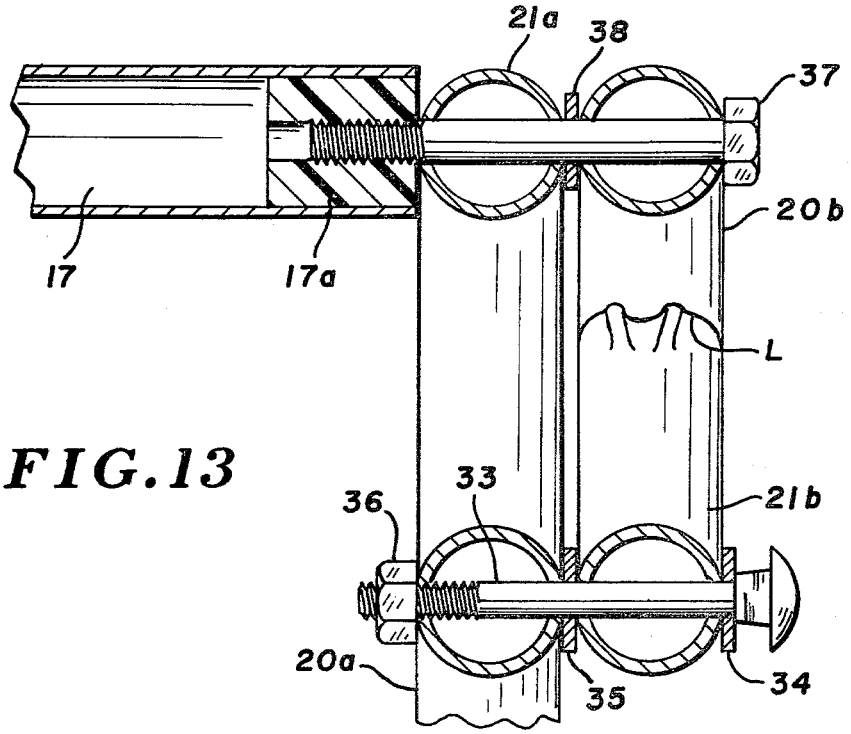
Figure 14:
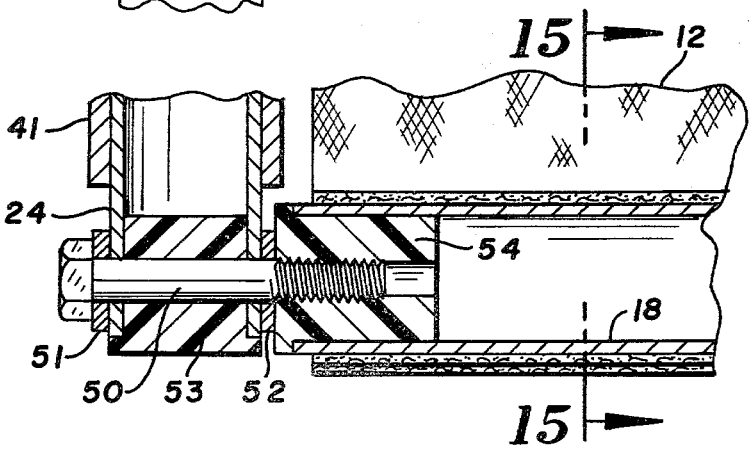
Figures 15, 16:
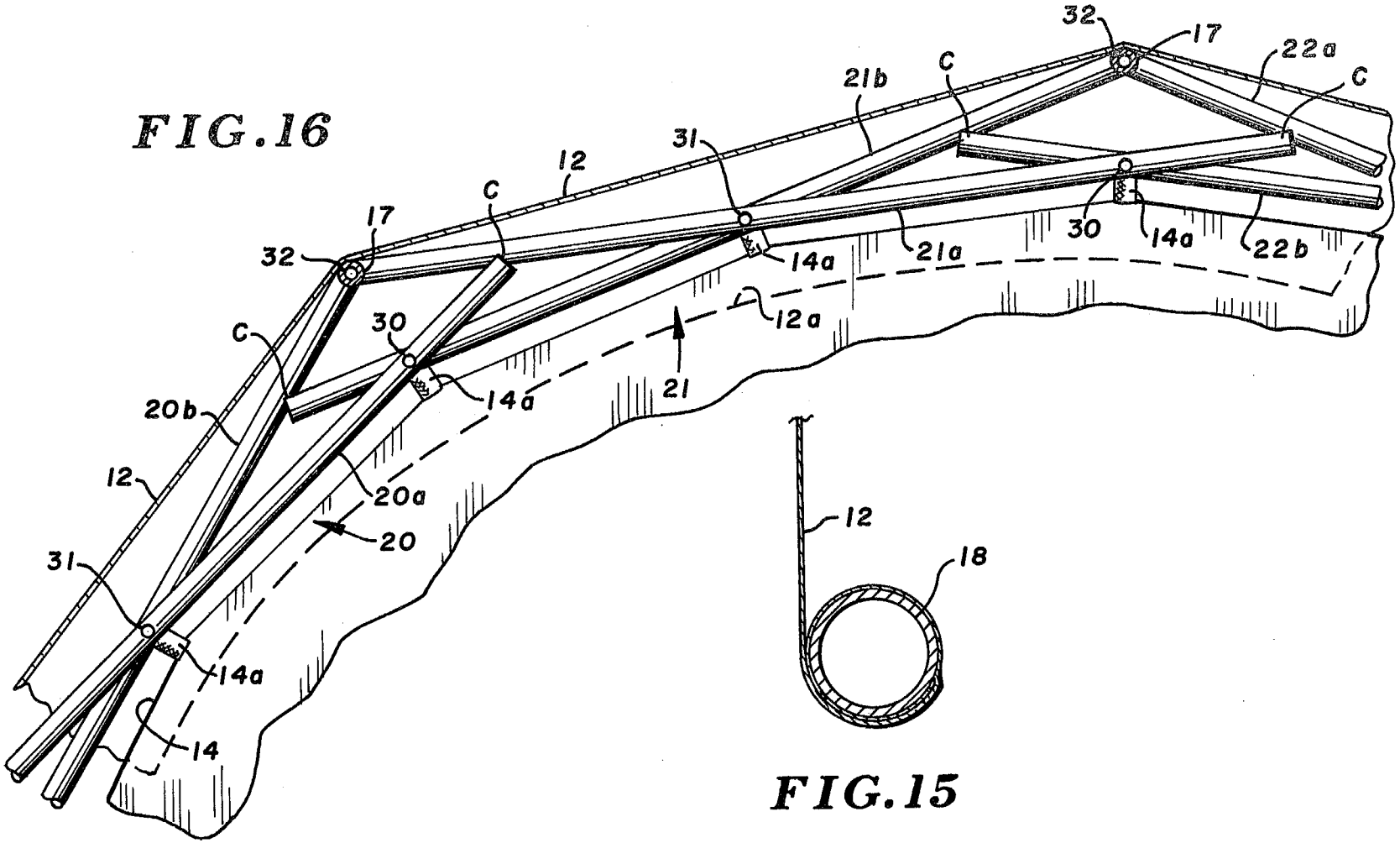

FIG. 4 is a vertical section taken substantially along Line 4—4 of FIG. 1 and illustrating the internal supporting framework on the rear portion of the structure and showing the outling of the rear closure panel in solid lines as supported by the framework and illustrating the outline of the weather or closure flap of the main covering panel in dotted lines as the same is arranged exteriorly of such closure panel;

FIG. 5 is a side elevation of the framework of the structure without the exterior covering;

FIG. 6 is a vertical section taken substantially along Line 6—6 of FIG. 5;

FIG. 7 is a vertical section taken substantially along Line 7—7 of FIG. 4 and illustrating the anchoring portion for the unit in a normal single unit hold down position with solid lines and in a plural unit hold down position by dotted lines;

FIG. 8 is a horizontal view taken substantially along Line 8—8 of FIG. 7, again illustrating the anchoring portion in the two recited positions;

FIG. 9 is a transverse section taken substantially along Line 9—9 of FIG. 4;

FIG. 10 is a section taken substantially along Line 10—10 of FIG. 9;

FIG. 11 is a view taken substantially along Line 11—11 of FIG. 6 and particularly illustrating the formed abutment of the tubular structural elements of the framework;

FIG. 12 is a section taken substantially along Line 12—12 of FIG. 11 to further illustrate the abutment of the tubular members of the framework;

FIG. 13 is a view taken substantially along Line 13—13 of FIG. 4 and particularly illustrating the method of connection used at the scissors connective points and the connective arrangement for securing the longitudinally extending members of the framework;

FIG. 14 is a vertical section taken substantially along Line 14—14 of FIG. 4, particularly illustrating a form of connection for a rotatable longitudinal member by which the covering for the unit is tightened;

FIG. 15 is a vertical section taken substantially along Line 15—15 of FIG. 14; and, FIG. 16 illustrates a portion of FIG. 4 and being drawn to an enlarged scale.

In accordance with the accompanying drawings, the collapsible, portable shelter or structure embodying the concepts of the invention is generally designated to and basically includes a framework 11, a covering therefore 12, a frontal closure panel 13 and a rear closure panel 14. Although the concepts of this invention are applicable to shelters of any particularly size, the basic concept of the shelter illustrated is to afford a shelter of a size to accommodate many persons in upright positions or which may be used as display or storage areas for vehicles and the like. The device is particularly constructed and will be described for longitudinally joining a plurality of such units and for this particular useage, the frontal and rear panels or closure units are easily removed from the framework such that a common enclosure will be provided. Though the description may be directed to units of such large size, it should be understood that size of the unit may easily be changed for other uses.

Some obvious uses for such devices, in addition to those mentioned, would be protection at construction sites, gravesite coverage, greenhouses and any other temporary shelter situation which requires rapid and simple erection with a large area of coverage and protection.

The framework 11 and its construction is the basis for the unit and the framework basically includes a front scissor frame structure 15, a rear scissor frame structure 16 and a plurality of longitudinally extending connective members 17 arranged for connection at the respective ends thereof to the rear 16 and front 15 scissor frame structures. As shall be discussed hereinafter, one of the lower longitudinal connective members 18 is provided for controlled rotation between the front 15 and rear 16 frames to control the tension on the covering fabric 12.

The basic framework of either the front or rear framework sections 15, 16 is best illustrated in FIGS. 4, 6 or 16. Each of the sections 15, 16 is identically formed and therefore the same reference numerals shall be used for each element discussed.

Figure 2:
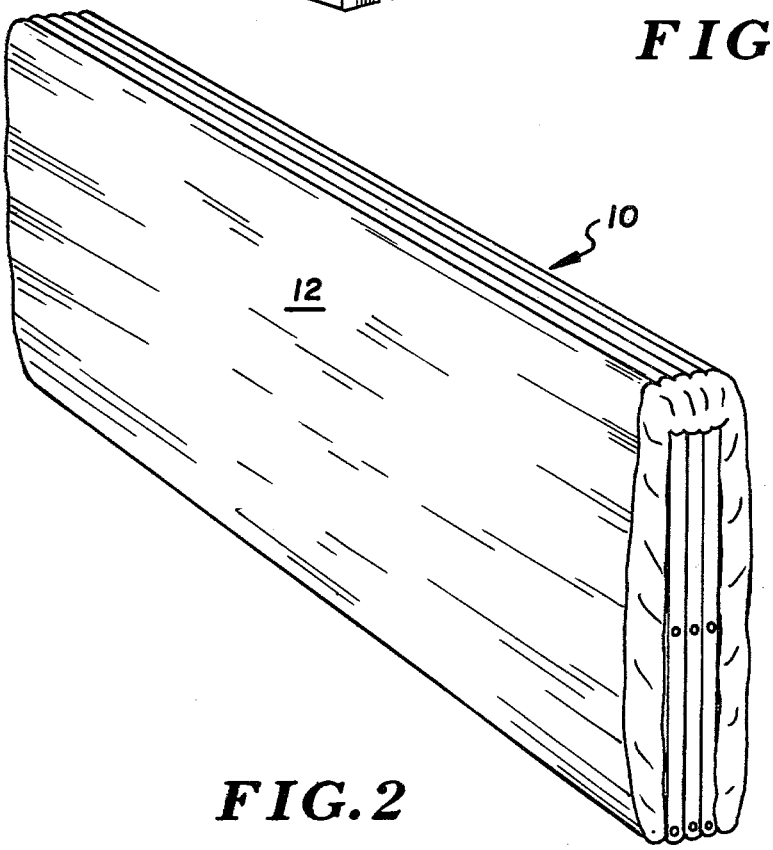
FIG. 2 is a perspective view of the structure being shown in collapsed position.

Each framework section 15, 16 includes, in the form shown four complete scissor sections 20, 21, 22, 23 and two, what may be termed half-scissor or vertical, ground engaging sections 24, 25. All of these sections are pivotally joined such that the entire unit may be folded to have each such section lie in side-by-side relation as illustrated in FIG. 2. This compact folding is necessary for shipping and other transportation of the unit.

Each such scissor section 20, 21, 22, 23 includes a pair of link members **20*a*, 20*b*; 21*a*, 21*b*; 22*a*, 22*b* and 23*a*, 23*b*. As illustrated, those links having the "a" designations may be termed interior links and thosing having a "b" designation may be termed exterior links. The interior and exterior designation only referring to the fact that the links a and b lie side-by-side with the "b" links forming the outer most section of the frameworks 15, 16. As illustrated, each link member is provided with three distinct pivot points or pivotal connections. One such pivot point is designated respectively 30 for each a or b link and this pivot point is spaced a predetermined distance from the ultimate end of such link. The points 30 are each pivotally joined to one another and this particular joinder is illustrated in FIG. 13** and will be discussed hereinafter. It should be stated that this joinder then joins one end of each "a" link to one end of the next adjacent "b" link to provide a first pivotal connection between adjacent scissor sections.

Each link is provided with a second pivot point and this point is designed 31. As illustrated, this pivot and connective point is located at the center of the remaining length of the links and this pivot connection joins the two links of each individual scissor section. The construction of this pivot 31 is partticularly illustrated in FIG. 9 and will be discussed hereinafter.

The third pivotal connective point for each of the links is designated 32 and is located at the end of the link opposite that of pivot 30. This pivotal connective member is particularly illustrated in FIG. 13 and this pivotal connective point also serves as a means for joining the longitudinally extending support elements between the frontal and rear framework portions 15, 16. As illustrated, this connection point is provided on the end of all such links are serves the joinder of one end of a "b" link to the "a" link of the next adjacent scissor section.

The term next adjacent scissor section is made with reference to FIGS. 4, 6 and 16 and movement is made from left to right.

The first and second pivotal connections 30, 31 are illustrated in FIGS. 9 and 13. As illustrated therein, a carriage or should bolt 33 is passed through apertures through the links to be joined and a friction reducing washer 34 is provided between the shouldered portion of the head of the bolt 33 and the "b" link such that the head of the bolt is displaced from the "b" link and a second washer 35 is placed between the two links. The nut 36 is then provided on the threaded end of the bolt 33 to pivotally lock the links together. The use of the displaced head of the bolt 33 will be shown hereinafter.

The third pivotal connection is particularly illustrated in FIG. 13. As illustrated therein, a plug of an expandable material such as nylon is inserted in the end of the longitudinal strut or connective member 17 and this plug **17*a* is provided with internal threads along only a portion thereof. The two links to be joined are arranged in side by side fashion and a connective bolt 37 is passed through apertures formed therein. A friction reducing washer 38 is provided between the tubes or links and when the bolt is tightened into the partially threaded plug, it becomes locked therein and therefore provides a pivot point for the links while positively holding them in proper position and while properly retaining the longitudinal strut 17**.

From a comparison of FIGS. 4, 6, 16 and 13, the length of link extending from the pivots 30 to the end of the links should be obvious. This extending length is sufficient to have the extreme end of the link abut with the underside of the link being joined at pivot 32. This abutment is illustrated by the curvilinear line L illustrated at the extremity of element **21*b*. The particular configuration to provide for additional interlock between such link extending ends and the link to which it abuts is also illustrated in FIGS. 11 and 12**.

As illustrated in FIG. 11, the link or tube which is to be brought into abutting relation with an overlying tube is provided with a defined alignment area. This area is formed by providing a pair of longitudinal ridges or flanges 50*a*, 50*b* spaced arcuately about the formed or swedged end of the link. A properly engaged set of links is illustrated in FIG. 12 which illustrates the cradling effect of such formation being provided to one of the tubes. It should be obvious that other means such as a dimple and depressed area could achieve this same result and similar other means could provide this same stabilizing effect.

The four complete scissor sections 20, 21, 22 and 23 provide the arched effect for the structure and the outer two such sections 20 and 23 are joined to the aforementioned half-scissor or vertical sections 24, 25 in much the same manner as they are interconnected with minor modifications.

For this particular joinder, in order to obtain the continuity of abutment with the necessary "a" and "b" lengths as is accomplished with their side-by-side relation, section 24 is provided with a full vertical link 24*b* and a half link 24*a* while section 25 is provided with a half link 25*b* and a full vertical link 25*a*. The half links are substantially equal to any of the previously described links from the extending free ends thereof beyond the pivots 30 to the location of the pivot 31. The full or vertical links 24*b*, 25*a* provide only one required length and this length is that of the dimension of any other link from pivot point 31 to pivot point 32. This particular dimension is denoted on section 24 as 24*c* and on section 25 as 25*c*. This particular length is critical and must be identical to allow the half links 24*a*, 25*b* to be joined respectively to link 20*b* at pivot 30 and 23*a* at pivot 30 and have their respective ends thereof pivotally joined to the vertical at pivots 31. Pivot 31 again providing a connection for the longitudinal strut 17.

It should be noted that the particular length of the total vertical sections 24, 25 is simply a matter of choice after compliance with the geometry to position and connect the end of the half links 24*a*, 25*b* thereto. The remainder of these links could be minimal or could be chosen to greatly elevate the arched portion of the unit. It should be obvious that an increase in length of these sections would precipitate a requirement for bending or telescoping the same to provide the compact package as shown in FIG. 2.

The means for anchoring the unit to the ground or the like are best illustrated in FIGS. 7 and 8. A typical vertical strut 24 is illustrated and a foot mechanism is provided thereon. It should be obvious that this foot mechanism 40 should be provided on each of the vertical sections 24 and 25 on both the front and rear frameworks, 15, 16. The foot mechanism 40, in the form shown includes a first tubular member 41 of a size to slide vertically and rotate about the vertical strut 24. A notch may be provided in the lower end of this tube for location of the foot 40 and preferably, to accommodate the two positions of this foot mechanism 40, two notches (one being shown) designated 42 are provided and are offset 90° with respect to one another such that the tie down extension 43 of the tubular member 41 may be arranged in alignment with the front or rear frameworks 15, 16 or alternatively may be shifted 90° therefrom to be in alignement with the side walls of the unit.

The tie down extension provides an outwardly extending flange having an eye-bolt 43*a* or the like affixed thereto such that a stake or the like may be driven therethrough into the ground and the shank of the eye-bolt may be used to tie a tensioning string as will be described hereafter thereto. As should be obvious, the foot mechanism 43 may be positioned through the notches 42 provided therein and an extending pin 44 arranged in positive position on strut 24 in one of two positions shown simply by lifting, rotating and lowering the mechanism 40. The foot mechanism will be used in the solid line position when a single unit is utilized or for closing one end of a set of adjacent units but will be used in the dotted line or open position when a plurality or simply adjacent units are desired. As will be shown hereinafter, the two placements provide a shifting of the covering fabric for advantages in both instances.

Figure 3:
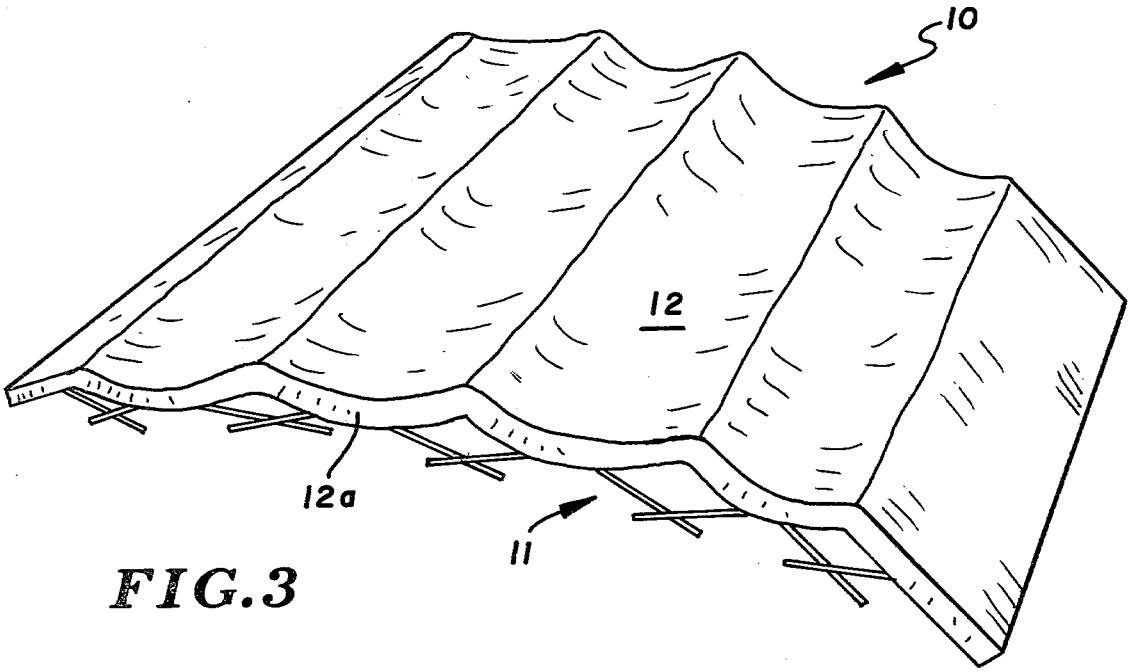
FIG. 3 is a perspective view of the structure showing the same in a partially open position.

The shifting of the framework from a closed position to an open position whould be obvious as the framework is shiftable only to its open position and then must be returned to its folded position through a reversal of the procedure. The abutment of the links prevents movement past the predetermined open position and the framework without any exterior covering is self supporting and locked into open position by the geometry thereof. The folding of the frame is accomplished by spreading the two vertical sections 24, 25 from one another to cause the unit to take the substantially flat position of FIG. 3 and thereafter, the unit is pushed together to take the posture of FIG. 2.

As previously stated, a basic portion of the unit includes the covering for the basic framework, such covering being designated 12.

The main covering material is provided of a width to cover the framework when the same is in its erected form but is of a length slightly longer than the entire framework such that a weather flap 12*a* or the like is provided on each end of the unit. This extending weatherflap 12*a* serves two purposes for covering and enclosing the unit with an additional purpose of strengthening the erected unit.

The weatherflap 12*a* is provided with a string or cord receiving perimeter seam 12*b* and a tightening cord 12*c* is received therein. The purpose of this seam and cord is to provide a controllable edge for the front and rear portions of the cover and as illustrated in FIG. 1 tightening of the cord will draw the weatherflap into a substantially curved configuration which extends slightly downwardly over the front and rear framework sections 15, 16. This tie down or tensioning cord may be attached to the aforementioned eye-bolt 43*a* of the foot mechanism 40.

Means are also provided to tension the cover about the width of the erected structure. As stated, one of the longitudinal struts 18 is provided for rotation. One method for accomplishing this is illustrated in FIG. 14. Initially the width of the covering material 12 will be placed about or attached to the lowermost longitudinaly strut 17 on the opposite side of the frame and will be secured to the rotatable longitudinal strut 18 such that as the same is rotated, the fabric 12 will be rolled up thereon, thus tensioning the fabric about the frame and thereby increasing the rigidity of the frame. As illustrated in FIG. 14, the longitudinal strut 18 is provided between, for example, the vertical struts 24 and a bolt or the like with means for rotation thereon is passed through apertures through the strut 24. Such bolt is designated 50 and washers 51, 52 are provided on each side of the strut 24 for ease of rotation of the bolt 50. A supporting member 53 is provided within the strut 24 to prevent collapse thereof and this supporting member is also a high friction member such that the bolt 50 will not rotate therein unless rotative pressure is applied thereto. The end of the strut 18 is provided with a plug 54 which fits securely into the passage of the strut 18 and which is partially threaded to further expand when the bolt 50 is threaded thereinto. The combination of these or similar elements will allow rotation of the strut to roll the fabric thereon with a particular application of rotative pressure to the bolt 50 and the friction of the construction will prevent unrolling thereof.

It should be obvious that other means of rolling and holding this strut or otherwise tightening the fabric may be provided without departing from this concept of the invention.

Two other portions of the shelter have been discussed and these include the front and rear panels to close the front and rear of the unit. The means for providing and holding these units to the frame are unique in that they allow for ease of attachment or removal and will provide a proper interfitting to the main covering 12 of the unit.

As previously shown in FIGS. 9 and 13, an extending shoulder bolt or the like is provided at pivot points 30 and 31 of each of the scissor sections. The rear panel 14, illustrated is provided with a plurality of looped, tab members 14*a* which are located to be received over these particularly provided shoulder bolts 33 and are held thereon by the enlarged head portion of the same. The lowermost portions of this panel is secured to the foot mechanism 40 such that the same is held tautly held on the exterior portion of the front and rear frame portions 15, 16, but as illustrated in FIG. 9, the panels 13 or 14 are located interiorly of the weather flap 12*a*.

It is immaterial whether the front or rear panels include screening or the like or are simply closure panels.

It should be noted that, with the assured tensioning of the covering fabric 12 that the fabric bridges across the frontal and rear frame portions of the unit and rather rests only on the longitudinal struts 17.

When the unit is collapsed, the fabric, having the tension released will follow the folding of the scissor sections and will be retained therebetween for the compactness as illustrated in FIG. 2.

When it is desirable to adjacently join structures, the shiftable foot mechanism 40 and the tensioning available from the cord and seam structure will permit overlapping of the units such that a continuous, weatherproof covering is provided. Such continuity and the benefits thereof should be obvious and it should also be obvious that the prior art does not contemplate such joinder of units without a complex arrangement therefore.

It should be obvious that this invention provides a unique and simple method and structure for self supporting collapsible shelters which permits the joinder of longitudinally arranged shelter units and wherein the entire unit is provided in a singular package that does not require part assembly nor tools to complete the erection thereof.

What is claimed is:

1. A collapsible shelter structure including:

a. a front and rear foldable frame structure b. a plurality of longitudinally extending connective members extending between and connecting said front and rear frame structures;

c. each of said front and rear foldable frame structures including a pair of support contacting, link sections and at least one scissor link structure connected to said support contacting links;

d. each of said support contacting links including a first link member having one end thereof arranged for engagement with a support surface and having an upper end and including a scissor link having a first end thereof pivotally connected to said first link in spaced relation to said upper end of said first link member, said scissor link providing a pivotal attachment means in spaced relation to said first end and spaced from the other end thereof;

e. each of said scissor link structures including a pair of link members arranged in side-by-side relation and pivotally connected to one another generally centrally thereof and having a first pivotal connective end arranged for and pivotally connected to said upper end of said first link member and a second pivotal connection arranged in spaced relation to the other end thereof for connection to said support contacting link;

f. a covering material extending over and connected to the longitudinal struts of the structure;

g. a plurality of scissor link structures providing said front and rear foldable frame structures; and, h. each of said links of said scissor structures including an extending portion from said second pivotal connection and the end of said link, said extending portion being arranged in abutting relation to the next adjacent link of the next adjacent scissor structure.

2. The structure set forth in claim 1 and each of said scissor link structures of said front and rear frame structures including at least a pair of scissor link structures, each of said scissor structures including said pair of link members and each of said pairs of link members being arranged in side-by-side relation and being generally centrally pivotally connected, said first pivotal connective end of each such pair of link structures being respectively joined to the next adjacent pivotal connective end of said link structures and said second pivotal connections of adjacent link structures being pivotally joined together.

3. The structure set forth in claim 1 and the extending portion of said link being formed to provide an aligning abutment with said next adjacent link of the said next adjacent scissor structure.

4. The structure set forth in claim 3 and said extending portion of said link being concavely formed on at least a selected side thereof to conform the same to the link to which the same abuts.

5. The structure set forth in claim 1 and a shiftable foot mechanism arranged on the lower end of each of said support contacting links having means thereon for receiving a support surface attachment member for positively holding said lower end of said support contacting link to the support surface and said shiftable foot mechanism including a flange member arranged for shiftable rotation about each of said lower ends of said support contacting links and positionable thereon in a first plane in substantial alignment with the front and rear frame structures and shiftable therefrom to lie in a second plane in substantial alignment with the said longitudinal struts of said frame.

6. The structure set forth in claim 5 and tie down means arranged on said foot mechanism.

* * * * *